United States Patent [19]

Maeder

[11] 4,193,279

[45] Mar. 18, 1980

[54] CUP HOLDER ASSEMBLY

[75] Inventor: Edward G. Maeder, Minnetonka, Minn.

[73] Assignee: National Can Corporation, Chicago, Ill.

[21] Appl. No.: 900,269

[22] Filed: Apr. 26, 1978

[51] Int. Cl.[2] ..... B21D 22/00

[52] U.S. Cl. ..... 72/44; 72/344; 72/349

[58] Field of Search ..... 72/44, 344, 347, 348, 72/349, 272, 273

[56] References Cited

U.S. PATENT DOCUMENTS 4,084,422 4/1978 Zilges et al. ..... 72/272

FOREIGN PATENT DOCUMENTS 1036795 8/1958 Fed. Rep. of Germany ..... 72/273

489546 5/1974 U.S.S.R. ..... 72/264

*Primary Examiner*—Leon Gilden

*Attorney, Agent, or Firm*—Robert A. Stenzel; Ralph R. Rath

[57] ABSTRACT

A cup holder sleeve and its support assembly for use in a drawing and ironing machine that has a circular bore and is supported for radial as well as tilting movement of the axis of the elongated bore with respect to the support. The support includes a pair of members that cooperate to define a recess surrounding a circular opening and an enlarged portion of the cup holder sleeve is received into the recess and cooperates with a cupper support element. The cup holder support element and cup holder sleeve are normally radially centered with respect to the opening by centering springs and the cup holder sleeve is normally maintained in engagement with the support element by hold-down springs. The cup holder sleeve and support element can be moved radially while the cup holder sleeve can be tilted with respect to the support element and all of the elements are normally maintained in a predetermined position by the centering springs and the hold-down springs.

14 Claims, 4 Drawing Figures

10
24

20
12
22
26
30
P
28
28
32
14
34

CUP HOLDER ASSEMBLY

BACKGROUND OF THE INVENTION

The present invention relates generally to ironing machines and more specifically to an improved cupper sleeve support for a drawing and ironing machine.

In the formation of a "two-piece" container, it has been customary to utilize a plurality of die assemblies that cooperate with a punch for converting circular metal discs into finished containers which have a sidewall and an integral end wall. One of these processes consists of originally drawing a circular metal disc into a cup utilizing what is commonly referred to as a cupping machine. The cup is then transferred to a bodymaker wherein the cup is converted into the finished container. In one process, which is being used commercially, the preformed cup is first redrawn to a smaller diameter and larger height and then is substantially simultaneously converted to an ironed container wherein the sidewall thickness is reduced in one or more steps. One type of such commercial machine is produced by Ragsdale Bros., Inc. and is identified as a Model CR-24 canwall drawing and ironing press. Normally the material for such containers is either aluminum or tinplate.

In such a process, a punch normally cooperates with a plurality of ironing dies and the stroke of the punch is fairly long in order to produce conventional 12 and 16 ounce containers. The length of the stroke of the punch for the bodymaker or press has heretofore created substantial problems in producing a satisfactory container which has a uniform wall thickness in the sidewall thereof. One of the problems encountered has been in maintaining all of the elements in very accurate alignment with respect to each other in order to produce a finished container which has a uniform wall thickness around the entire perimeter thereof and also the entire length thereof.

In order to alleviate some of the problems in maintaining accurate alignment between the various dies and the punch, several proposals for producing floating ironing dies have been proposed. For example, British Pat. No. 724,251 published Feb. 16, 1955 discloses a method of supporting ironing dies that will accommodate movement of the dies with respect to the punch but will also provide a self-centering feature which theoretically will reposition the die to a predetermined position whenever all external forces have been removed. The particular arrangement for accomplishing the self-centering and floating feature in the assembly disclosed in the British patent consists of cooperating inclined surfaces between the ironing die and its support mechanism with a biasing mechanism which will automatically center the ironing dies with respect to a predetermined axis whenever external forces are removed. The biasing mechanism in this patent has been illustrated as either consisting of an elastomeric member or rubber ring which produces a centering action between an ironing die and a cooperating support. Alternatively, the centering means in the disclosed patent also shows the use of springs that cooperate with the ironing die and the support to center the ironing die with respect to a predetermined axis.

One additional problem that has been encountered in the formation of two-piece drawn and ironed containers has been encountered when the cup is initially formed and then is redrawn just prior to the ironing of the sidewall. In a redraw operation just prior to the ironing of the sidewalls of the cups, it is customary to hold the cup through what may be termed a cup holder sleeve in an accurate position with respect to the redraw ring just prior to the punch entering into the cup and forcing the cup through the redraw ring. It has been found that, under certain conditions, the cup holder sleeve is not accurately centered, while applying uniform hold-down pressure on the cup to hold the cup in a fixed position with respect to the redraw ring. This will produce an uneven redrawn cup which can produce a tear-off of the longer end either in the redraw stage or in subsequent ironing stages.

It has also been found that when there is no accurate alignment between the punch and the redraw which reshapes the cup, the wall thickness of selected portions of the cup may be reduced during the redraw process which results in ultimately having varying thicknesses in different portions of the sidewall of the finished container.

It has also been determined that if the cup holder sleeve face does not apply a uniform pressure to the cup it may wrinkle in selected areas during the redraw application.

SUMMARY OF THE INVENTION

According to the present invention, a cup holder sleeve assembly is designed to be capable of allowing the cup holder sleeve to automatically be moved radially with respect to the axis of a drawing and ironing machine and also be capable of being tilted with respect to the axis to accommodate accurate positioning of the cupper sleeve face with respect to the surface of the redraw ring and accurately position the cups with respect to a ring and apply uniform pressure to the cup.

More specifically, the cupper sleeve assembly which is specifically adapted for use with a punch of an ironing machine that is axially aligned with a redraw ring includes a support having an opening therein with a recess extending from the periphery of the opening and a cup holder sleeve and support element having portions received into the recess of the support. The support element and cup holder sleeve are normally maintained in a centered position with respect to the opening in the support by centering springs which accommodate radial movement of the support element and the cupper sleeve. The cup holder sleeve and support element have cooperating spherical surface segments that are normally maintained in engagement with each other through further hold-down springs which accommodate tilting of the axial bore in the sleeve with respect to the axis of the aperture in the support element.

According to one aspect of the invention, lubricating means are provided for supplying lubricant between the cooperating spherical surface segments on the support element and the cup holder sleeve as well as the supporting surfaces between the support element and the support which accommodates radial movement of the support element and cup holder sleeve within the support.

The unique support arrangement and lubricating means have been found to more uniformly spread unsymmetrical forces that are developed in the cup holder sleeve support assembly when a jam occurs. This in turn substantially reduces the possibility of creating permanent misalignment between the sleeve support and the redraw ring.

DETAILED DESCRIPTION

Figure 1:
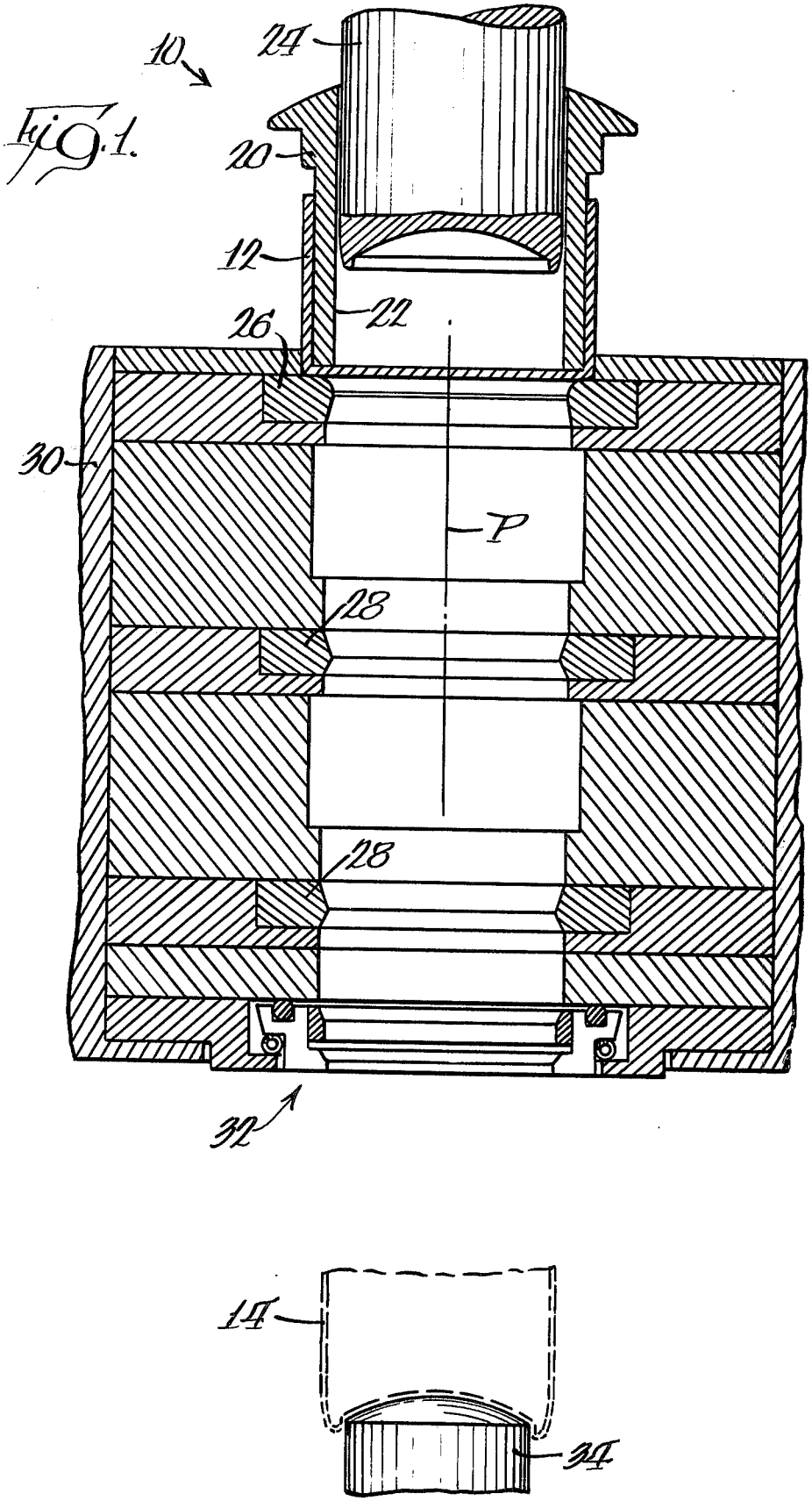
FIG. 1 schematically illustrates a fragmentary sectional view of a drawing and ironing machine into which the present invention can be incorporated.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings schematically illustrates selected portions of a bodymaker 10 used for converting a cup 12 into a finished container 14. Bodymaker 10 includes a cup holder sleeve 20 which has an axial bore 22 therein through which a punch 24 is adapted to be moved. Punch 24 is axially aligned with bore 22 and is movable along a path P which has a plurality of die assemblies. The first die assembly consists of a redraw ring 26 and the other die assemblies are ironing rings 28. Redraw ring 26 and ironing rings 28 are shown in a fixed position in a support 30 which is adapted to be mounted in a fixed position on a frame and also has a stripper assembly 32 associated therewith as well as a domer 34 aligned with the path P.

Before the stroke of punch 24 and cup holder sleeve 20 is initiated, a cup 12 is generally aligned with redraw ring 26 through a cup locating mechanism (not shown) and cup holder sleeve 20 is then moved axially generally to the position illustrated in FIG. 1 to hold the cup 12 in a fixed position with respect to redraw ring 26. Punch 24 is then moved axially through bore 22 to force the cup initially through the redraw ring 26 wherein the cup diameter is decreased and the cup height is increased and subsequently through the ironing rings 28 which cooperate with the peripheral surface of punch 24 to reduce the sidewall thickness of cup 12. After the cup has been passed through the respective rings, the lower end of the punch, which is generally dome shape in cross section, cooperates with domer 34 to reform the bottom wall of the cup and produce a finished container. During the return stroke of punch 24, stripper assembly 32 engages the upper free edge of finished container 14 to strip the container from the punch.

For practical considerations, a clearance must be maintained between the periphery of punch 24 and the inner surface of cup holder sleeve 20.

As was indicated above, one of the problems encountered in producing satisfactory containers utilizing a process described above, is to maintain accurate alignment of all of the various parts at all times. Any misalignment of any of the elements by even as little as one ten-thousandths of an inch will result in having a finished container which has a sidewall of uneven thickness. One of the most critical areas in the above described process is to make sure that the cup is accurately positioned with respect to the redraw ring and uniform hold-down pressure is applied to the cup before the drawing and ironing process is initiated.

Since the cup holder sleeve and the punch have radial clearance between them and are moved independently, there is no way in which the punch can be utilized for self-aligning the cup holder sleeve with respect to the axis of the punch which is presumed to be aligned with the center of the opening in redraw ring 26. Therefore, in cases of jams, the large unsymmetrical forces that are developed in the system may force the cup holder sleeve out of alignment with the axis of punch 24 and redraw ring 26. The result may be that the sleeve remains permanently misaligned after a jam and may become exaggerated during subsequent jams.

According to the present invention, cup holder sleeve 20 is mounted for universal movement with respect to the path P to facilitate tilting and radial movement during a jam while still remaining aligned after a jam.

As most clearly illustrated in FIG. 3, cupper sleeve 20 is supported in a cupper sleeve support 40 which consists of first and second members 42 and 44 which have cooperating threads 46 to be assembled with respect to each other, for a purpose that will be described later. Support 40 has a substantial circular opening 48 therein which is aligned with the circular opening 50 that is defined in the redraw ring 26 and the centers of these openings are located along the path P of punch 24. Members 42 and 44 cooperate with each other to define a recess 52 extending from the periphery of opening 48 and recess 52 has a shoulder 54 which extends substantially radially from the axis of opening 48. A support element or cup holder sleeve support member 60 has a peripheral portion 62 which is received into recess 52 and also has a contiguous cooperating surface 64 which is in engagement with shoulder surface 54. Support element 60 also has a circular aperture 66, therein, which is generally of the same size as bore 22 in cup holder sleeve 20.

According to one aspect of the invention, cup holder support element 60 and cup holder sleeve 20 are normally centered with respect to opening 48 through centering means which will now be described. In the illustrated embodiment, the centering means consists of four circumferentially spaced biasing means 70 that are equally spaced from each other around the perimeter of the substantially circular support 40. The respective biasing means 70 are spaced approximately 90 degrees from each other and produce equal forces around the perimeter of support element 60 to maintain the support element in a centered position with respect to the circular support 40 more particularly opening 48. The respective biasing means 70 are identical in construction and only one will be described in connection with FIGS. 2 and 3.

Figure 2:
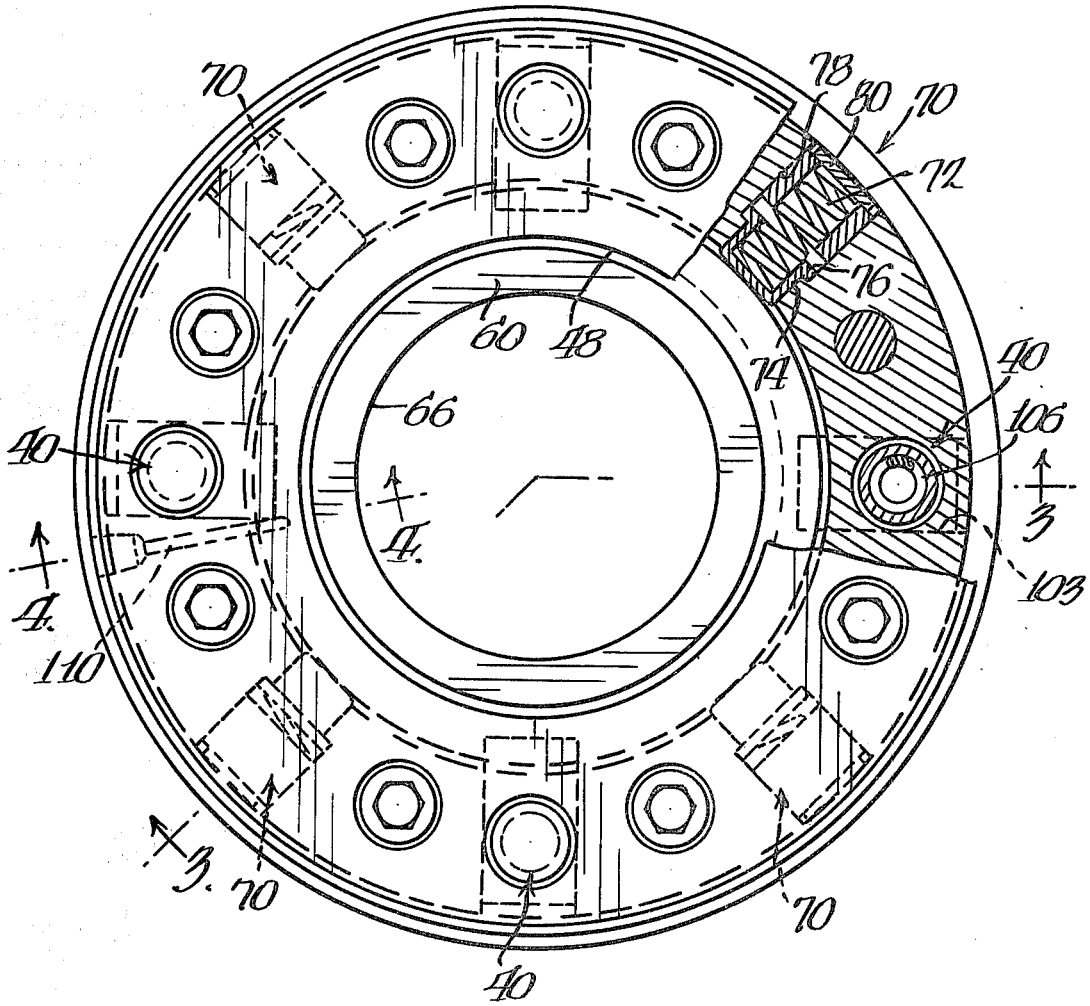
FIG. 2 is an enlarged plan view of the cupper sleeve support with portions thereof broken away for purpose of clarity.

Each biasing means 70 consists of a spring 72 that has one end received into a cup 74 which has an annular shoulder 76 cooperating with an enlarged portion 78 of a radial opening in support 40. The opposite end of spring 70 engages the inner surface of a support ring 80 which forms part of support 40. The springs 72 are selected so as to produce an equal force and cup 74 is designed so that the inner surface thereof is in engagement with the periphery of support element 60 as illustrated in FIGS. 2 and 3.

The cups 74 are all accurately dimensioned so that when the shoulders 76 engage with support 40, the free ends of the cups are on a common circle which has a diameter that is equal to the peripheral diameter of the support element 60. However, if external forces are applied to cup holder sleeve 20 which may result from a misfed cup or a defective cup, the springs will accommodate radial movement to prevent permanent misalignment between opening 48 and redraw ring 26. When the external forces are removed the springs which were compressed will return the sleeve to a centered position. The centering means or biasing spring 70 will, therefore, always accurately position support element 60 in a centered position with respect to opening 48 which is accurately centered with opening 50.

According to a further aspect of the invention, the axis of bore 22 of cup holder sleeve 20 can also be tilted with respect to the path P if there is a misfed cup to apply a uniform hold-down pressure at all times. For this purpose, support element 60 has an arcuate or spherical surface segment 90 on the lower surface thereof surrounding aperture 66 and the concave surface segment 90 cooperates with a convex surface segment 92 defined on an enlarged portion 100 on the upper end of cupper sleeve 20. The cooperating surface segments 90 and 92 will accommodate movement of the lower free end of cup holder sleeve 20 to allow the holder sleeve to assume an angular position wherein the axis of bore 22 is axially aligned with the axis of punch 24. The centers of spherical surface segments 90 and 92 are located at a point 95 which is located on path P.

Flat surfaces 54 and 56 and spherical surfaces 90 and 92 are normally held in engagement with each other through biasing means that cooperate with support 40 and cupper sleeve 20, as well as support element 60. For this purpose, enlarged portion 100 of cup holder sleeve 20 is received into recess 52 and spring biased tabs 102 are received in recesses 103 and cooperate with the lower surface of enlarged portion 100 for biasing the various surfaces into engagement with each other. More specifically, each tab (there being four equally spaced around the perimeter of support 40) has a cup 104 secured thereto as by welding and a hold-down spring 106 is telescoped into the cup. Cup 104 is received in an opening 108 in member 42 and one end of the spring engages the surface on member 44 which forms part of support 40.

The base of each recess 103 in member 42 defines an accurate space between the tab and surface 54 and such spacing will be maintained even when the spring forces for the respective springs are different.

Figure 3:
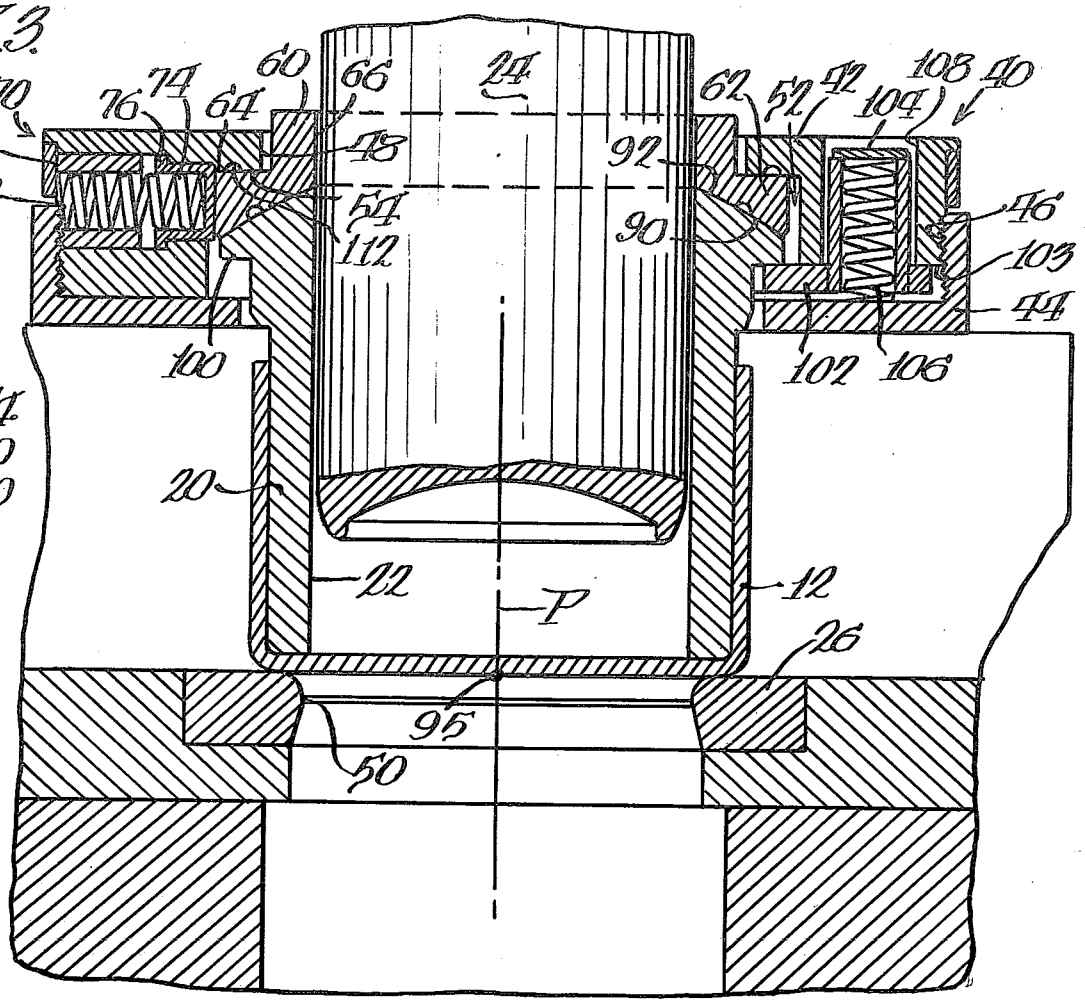
FIG. 3 is a fragmentary sectional view as viewed along line 3—3 of FIG. 2.

Thus, each tab 102 is biased into the position illustrated in FIG. 3 wherein the axis of aperture 66 and the axis of bore 22 are aligned with the axes of openings 48 and 50. However, should there be a need for having the cup holder sleeve 20 tilted with respect to the path P of punch 24, the tabs will allow a certain amount of tilting movement of the sleeve 20 with respect to support element 60.

Figure 4:
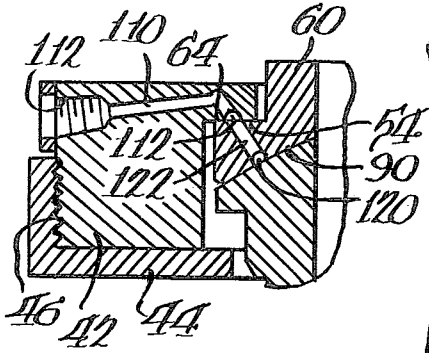
FIG. 4 is a fragmentary sectional view as viewed along line 4—4 of FIG. 2.

According to a further aspect of the invention, the various surfaces which are moved relative to each other are continuously lubricated through lubricating means which will now be described. The lubricating means is most clearly illustrated in FIG. 4 and consists of an opening 110 in member 42 which has a threaded exterior portion 112 to which a source of pressurized lubricant may be connected. The inner end of opening or bore 110 is in communication with a continuous circumferential recess 112 that is defined in shoulder surface 54 of member 42. The recess 112 extends around the entire perimeter of surface 54 and is also in communication with a second continuous recess 120 in surface 90 through one or more small openings 122. Therefore, a continuous flow of fluid from a source (not shown) through opening 112 will provide a constant supply of lubricant between the relatively movable surfaces of the cup holder sleeve assembly. This arrangement substantially reduces the frictional forces that must be overcome when the various elements have to be moved with respect to each other. Of course, the continuous supply of lubricant to these relatively movable surfaces will also substantially reduce the wear of the overall assembly.

Summarizing, during continuous operation of the bodymaker, cups are sometimes misfed and other times are defective which will produce jams. When jams occur, the cup is not located on cup holder sleeve and will be crushed by the hold-down pressure on the cup holder sleeve. This could produce large unsymmetrical forces on the cup holder sleeve which may permanently misalign or tilt the cup holder support with respect to the redraw ring.

However, with the universal mounting which accommodates radial and tilting movement of the cup holder sleeve, the forces resulting from a jam are more uniformly distributed to prevent permanent misalignment and tilting of the support assembly. After the jam is removed, the springs will restore the cup holder sleeve to a centered position.

It will also be appreciated that the cup holder sleeve assembly, with the parts arranged as described, can readily be assembled with a minimum amount of time. Since members 42 and 44, which form support 40, are threadedly interconnected, the various spring biasing means 70 can initially be inserted into openings 78 and supporting ring 80 positioned over the periphery of member 42 to hold the springs. Support element 60 and enlarged portion 100 of cupper sleeve 20 can then be inserted into the partially formed recess 52 in member 42. Springs 106, and tabs 102 with 104 are then inserted into the openings 108 and the second member can then be threaded onto the first member to a locked position illustrated in FIG. 4 to assemble all of the parts. After assembly of the parts as illustrated in FIG. 3, the spherical surface segments 90, 92 will accommodate tilting movement of the axis of the bore 22 with respect to path P while the radial surfaces 54 and 64 will accommodate radial movement of the cupper sleeve 20 as well as support element 60 with respect to support 40. Springs 106 will usually hold the surfaces in engagement but will accommodate some axial movement of support element 60 and cupper sleeve 20 in recess 52 so that surfaces 90, 92 and 54, 64 can separate. However, whenever all of the external forces are removed, all of the elements are repositioned in alignment as illustrated in FIG. 3 where the tabs are forced against the bottoms of recesses 103 to accurately restore the cup holder sleeve to a centered aligned position.

It has been found that utilizing the radially movable and axially tiltable cup holder sleeve and the lubricating means will maintain more accurate alignment of the support assembly 40 with redraw ring 26. With accurate alignment of the parts, the containers produce will have more uniform wall thickness which thereby reduces the number of containers that must be discarded.

What is claimed is:

1. In a drawing and ironing machine including a fixed frame, a ring carried by said fixed frame and having a first circular opening therein, a punch movable axially of said first circular opening, a cup holder sleeve interposed between said punch and said ring, said cup holder sleeve having an axial bore for receiving said punch, and a support for said cup holder sleeve, the improvement of said support including a first member having a second circular opening therein aligned with said first circular opening and having a circumferential recess extending from the periphery thereof, a movable support element having a peripheral portion received in said recess and cooperating with one end of said cup holder sleeve, said support element having a circular aperture and being movable radially of said second circular opening, and biasing means between said first member and said support element normally maintaining said support element centered with respect to said second circular opening and accommodating radial movement of said one end of said cup holder sleeve and said support element in said openings.

2. A drawing and ironing machine as defined in claim 1, further including means between said support element and said cup holder sleeve accommodating tilting of the axis of said axial bore with respect to an axis through the centers of said circular openings.

3. A drawing and ironing machine as defined in claim 2, in which said last means includes confronting arcuate surfaces between said support element and said cup holder sleeve and further biasing means for urging said surfaces into engagement with each other, said further biasing means yielding to allow said surfaces to move relative to each other.

4. A drawing and ironing machine as defined in claim 3, further including lubricating means for applying lubricant between said confronting surfaces.

5. A drawing and ironing machine as defined in claim 4, in which one of said surfaces has a continuous recess therein and the lubricant is delivered to said recess.

6. A drawing and ironing machine as defined in claim 1, in which said recess in said first member defines a shoulder with said support element having a contact surface in engagement with said shoulder further including means for applying lubricant between said shoulder and said contact surface.

7. A drawing and ironing machine as defined in claim 6, further including hold-down springs for biasing said contact surface into engagement with said shoulder.

8. A drawing and ironing machine as defined in claim 7, in which said support element and cup holder sleeve have mating spherical surface segments accommodating tilting of said cup holder sleeve with respect to the axis of said circular aperture and said hold-down springs normally maintain said bore in said cup holder sleeve axially aligned with said circular aperture.

9. A cup holder sleeve assembly for use with a punch of an ironing machine comprising a support having an opening therein with a recess extending from the periphery of said opening, an elongated cup holder sleeve having an axial bore therein and an enlarged portion at one end received in said recess, a support element having an aperture therein and having a peripheral portion received in said recess with said recess having a shoulder surface extending perpendicular to the axis of said aperture and said peripheral portion having a contiguous cooperating surface, means for applying lubricant to said surfaces to accommodate radial movement of said aperture with respect to said opening, first biasing means normally maintaining said aperture centered with respect to said opening and second biasing means normally maintaining said surfaces in engagement with each other.

10. A cup holder sleeve assembly as defined in claim 9, in which said support element has a concave spherical surface segment surrounding said opening and said enlarged portion of said cup holder sleeve has a convex spherical surface segment nesting with said concave surface segment, and in which said second biasing means normally maintains said spherical surface segments in engagement with each other.

11. A cup holder sleeve assembly as defined in claim 10, in which said means for applying lubricant also supplies lubricant between said spherical surface segments.

12. A cup holder sleeve assembly as defined in claim 11, in which said means for applying lubricant includes means defining a continuous recess in one of said shoulder and cooperating surfaces and in one of said spherical surface segments.

13. A cup holder sleeve assembly for use with a punch and an axially aligned redraw ring to hold a cup with respect to the redraw ring, comprising a support having a circular opening therein, a cup holder sleeve having an axial bore for receiving the punch, and support means between said cup holder sleeve and said support, the improvement of said support means including a support element carried by said support and cooperating with said cup holder sleeve, said support element being movable radially of said circular opening, circumferentially spaced biasing means between said support and said support element for normally maintaining said support element centered with respect to said circular opening in said support, said cup holder sleeve and said support element having cooperating surfaces accommodating tilting of the axial bore with respect to the axis of said opening and biasing means maintaining said cooperating surfaces in engagement with each other.

14. A cup holder sleeve assembly as defined in claim 13, in which said support and said support element have radially extending surfaces accommodating radial movement, further including lubricating means for supplying lubricant between said cooperating surfaces and said radial surfaces.

* * * * *